US008154422B2

(12) United States Patent
Hsu et al.

(10) Patent No.: US 8,154,422 B2
(45) Date of Patent: Apr. 10, 2012

(54) VEHICLE COLLISION AVOIDANCE SYSTEM AND METHOD

(75) Inventors: Chan-Wei Hsu, Changhua Hsien (TW); Liang-Yu Ke, Kaohsiung (TW); Chih-Neng Liang, Changhua Hsien (TW)

(73) Assignee: Automotive Research & Testing Center, Changhua Hsien (TW)

( * ) Notice: Subject to any disclaimer, the term of this patent is extended or adjusted under 35 U.S.C. 154(b) by 370 days.

(21) Appl. No.: 12/508,947

(22) Filed: Jul. 24, 2009

(65) Prior Publication Data

US 2011/0018737 A1 Jan. 27, 2011

(51) Int. Cl.
*G08G 1/16* (2006.01)

(52) U.S. Cl. ..... 340/903; 340/905; 340/933; 340/937; 701/301; 701/117; 701/45

(58) Field of Classification Search ..... 701/301, 701/117, 213, 45; 340/903, 905, 933, 937
See application file for complete search history.

(56) References Cited

U.S. PATENT DOCUMENTS

| | | | | |
|---|---|---|---|---|
| 6,405,132 | B1 * | 6/2002 | Breed et al. | 701/301 |
| 2006/0119473 | A1 * | 6/2006 | Gunderson et al. | 340/435 |
| 2008/0161987 | A1 * | 7/2008 | Breed | 701/27 |

* cited by examiner

*Primary Examiner* — Daryl Pope
(74) *Attorney, Agent, or Firm* — Frenkel & Associates, PC

(57) ABSTRACT

A vehicle collision avoidance system is implemented in a host vehicle. A wireless communication module in the host vehicles wirelessly broadcasts vehicle information packages of the host vehicle and receives external vehicle information packages from other neighboring vehicles. Based on the received vehicle information packages, a collision avoidance process is performed. The process has steps of mapping coordinates system, categorizing collision zones, determining whether a possible collision position exists, calculating a collision time and outputting warning messages. The estimations of the possible collision position and the collision time are not affected by the positions of the neighboring vehicles. Therefore, the neighboring vehicles approaching the host vehicle from different direction are effectively monitored.

15 Claims, 10 Drawing Sheets

$\angle\overrightarrow{AC} \neq H_A$ $\angle\overrightarrow{BC} = H_B$ $\angle\overrightarrow{AC} = H_A$ $\angle\overrightarrow{BC} = H_B$ Lateral
Collision

VEHICLE COLLISION AVOIDANCE SYSTEM AND METHOD

BACKGROUND OF THE INVENTION

1. Field of the Invention

The present invention relates to a vehicle collision avoidance system and method, particularly a system which is installed in a host vehicle and provides warning messages to avoid the occurrence of collisions with other vehicles in advance.

2. Description of Related Art

Factors that cause traffic accidents can be categorized as human factors and unavoidable natural factors. If the human factors are effectively eliminated in advance, the probability of the traffic accidents can be reduced. In order to ensure safe driving, more and more safety products are designed and available.

Because collided vehicles may cause serious damages, a variety of collision avoidance techniques is proposed, including the electromagnetic wave type, optic type, acoustic type and mechanical type products. The electromagnetic wave-based product has the advantage of long-distance scanning, but its scanning range will be limited by the directional property of the electromagnetic wave signals and also require higher manufacturing cost. The optic type product is suitable for widely scanning but it requires high manufacturing cost. Optic sensing signal is also limited by the directional property. The sonic sensing signal of acoustic type product cannot transmit very long and is unsuitable for vehicles moving at a high speed result of medium propagation, but the manufacturing cost is relative low. The mechanical type product, such as a bumper mounted in front or rear portions of the vehicle, is designed for decreasing the collision force, not for warning the driver in advance.

A Taiwan patent, no. I284297, entitled "Intelligent collision avoidance system and method", a vehicle broadcasts its vehicle information to other neighboring vehicles and also receives external vehicle information from the neighboring vehicles. Based on the received vehicle information, a processor of the vehicle determines whether the collision with other neighboring vehicles may occur. The processor utilizes the coordinates of the vehicles to calculate a relative angle between the moving direction of two analyzed vehicles, and the method estimates a possible collision position using projection technique. The patent method finally estimates a collision time based on the geometric projection data as expressed by equations 9 and 10. Calculating the time parameters $T_A$ and $T_B$ in the equations 9 and 10 involves the computation of the tangent function. However, the calculated result of the tangent function may become divergent rapidly and be impracticable as the angle increases, moreover, the proposed method cannot adapt all practical situations to predict possible collisions with other vehicles coming from different directions.

To overcome the shortcomings, the present invention provides a vehicle collision avoidance system and method to mitigate or obviate the aforementioned problems.

SUMMARY OF THE INVENTION

An objective invention, vehicle collision avoidance system and method, provides effectively monitor neighboring vehicles coming from different direction so as to provide an early-warning messages for the vehicle driver when a possible collision will occur.

The vehicle collision avoidance system is implemented in a host vehicle. A wireless communication module in the host vehicle wirelessly broadcasts own vehicle information packages and receives external vehicle information packages from other neighboring vehicles. Based on the received vehicle information packages, a collision avoidance process is performed. This patent processes have several steps, including mapping coordinates system, categorizing collision zones, determining whether a possible collision position exists, calculating a collision time and outputting warning messages. The possible collision position and the collision time estimations will not be influenced by the neighboring vehicles in arbitrary direction. Therefore, the neighboring vehicles approaching the host vehicle from different direction can be strictly monitored.

Other objectives, advantages and novel features of the invention will become more apparent from the following detailed description when taken in conjunction with the accompanying drawings.

DETAILED DESCRIPTION OF PREFERRED EMBODIMENT

Figure 1:
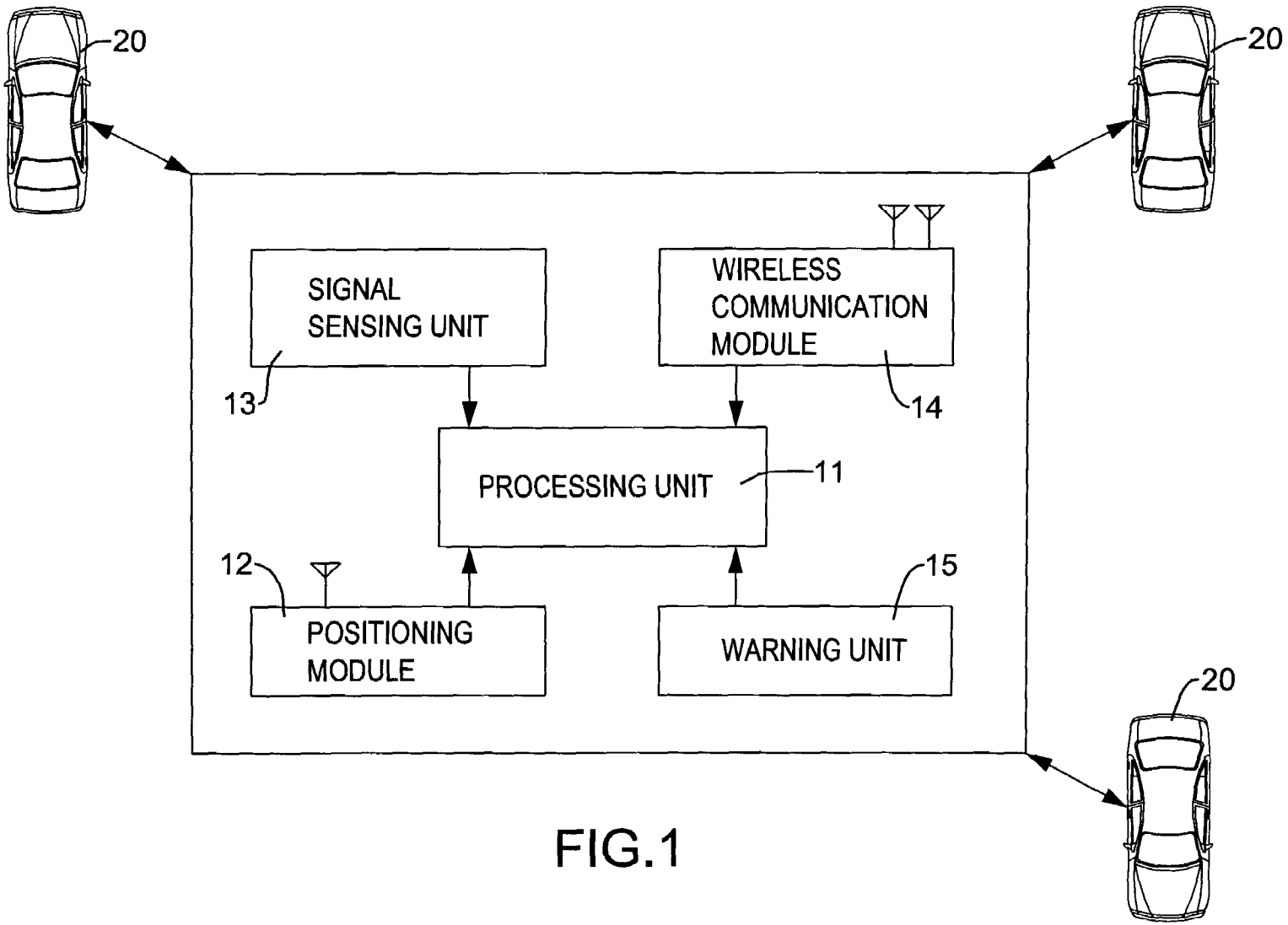
FIG. 1 is a block diagram of a vehicle collision avoidance system in accordance with the present invention.

With reference to FIG. 1, a vehicle collision avoidance system in accordance with the present invention is implemented in a vehicle, hereinafter a host vehicle, and comprises a positioning module (12), a processing unit (11), a signal sensing unit (13), a wireless communication module (14) and a warning unit (15).

The positioning module (12), such as a GPS module or a radar device, provides position data of the host vehicle.

The processing unit (11) receives the position data of the host vehicle, estimates a driving speed and direction of the host vehicle, integrates the driving speed and direction into vehicular information packages, and built in a collision avoidance process.

The signal sensing unit (13) senses and outputs different types of the vehicle signals to the processing unit (11). For example, the signal information may comprise positioning data and not be bounded to turn signals, braking signals or accelerator status of the vehicle.

The wireless communication module (14) which is connected to the processing unit (11) continuously broadcasts the vehicular information packages of the host vehicle produced by the processing unit (11). Each vehicular information package comprises the position data of host vehicle, the driving speed, heading angle and other information provided by the positioning module (12) and the signal sensing unit (13). The wireless communication module (14) communicates with other wireless communication modules of other neighboring vehicles (20) and receives the external vehicle information packages sent from the neighboring vehicles (20) via compatible channels and protocol. The received external vehicle information packages are transmitted to the processing unit (11).

The warning unit (15) which produces warning messages is connected to and driven by the processing unit (11) for reminding the driver. The warning messages may be showed in form of a graphical image, or made sounds. In this embodiment, the warning unit (15) is a display and an early warning image with alerting sounds to remind the driver.

In the following description, the positioning module (12) is implemented by GPS device, and the position data of host vehicle is the reference point acquired from the GPS device.

When the present invention is installed and activated in vehicles, the positioning module (12) continuously receives satellite positioning data (i.e. NMEA-0183). The GPS device converts the satellite positioning data into coordinates and transmits the related positioning data to the processing unit (11). Based on the received reference point, the processing unit (11) computes the driving speed and the driving direction of the host vehicle, and integrates the driving speed, the driving direction and other signal data into vehicle information packages. The wireless communication module (14) will continuously broadcast the vehicle information packages of the host vehicle and receive the external vehicle information packages from neighboring vehicles (20). Upon the reception of the external vehicle information packages, the host vehicle performs the collision avoidance process to determine whether a possible collision exists.

Figure 2:
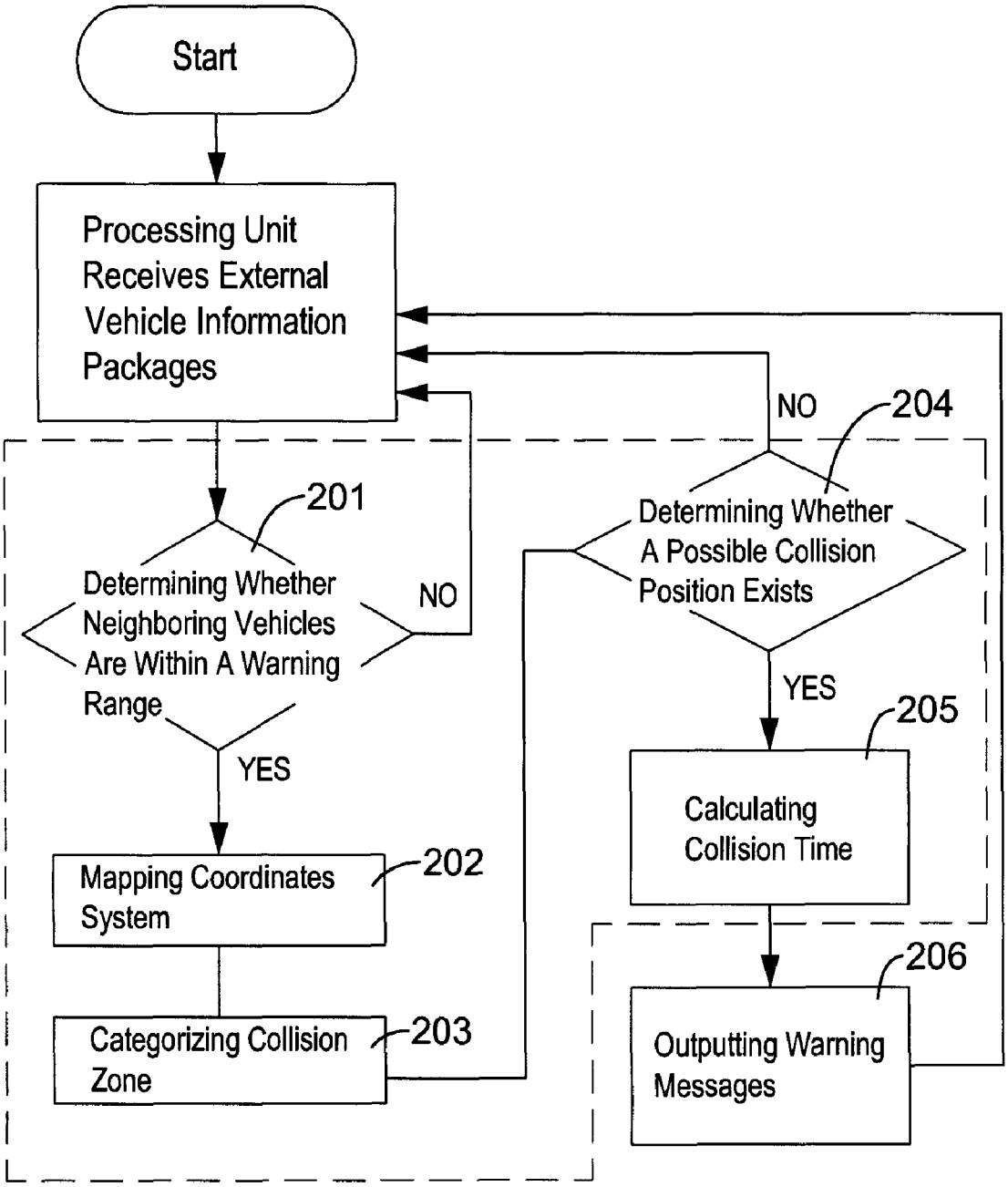
FIG. 2 is a flowchart of a vehicle collision avoidance method in accordance with the present invention.

With reference to FIG. 2, the process comprises the steps of determining whether neighboring vehicles are within a warning range (201), mapping coordinates system (202), categorizing collision zones (203), determining whether a possible collision position exists (204), calculating a collision time (205) and outputting warning messages (206).

In the step of determining whether neighboring vehicles are within a warning range (201), the processing unit (11) determines whether neighboring vehicles (20) are close to the host vehicle and in a default warning range by comparing the extracted coordinates extracted from the external vehicle information packages with the coordinate data of the host vehicle. The processing unit (11) will execute the next step (202) to perform computation task only if any neighboring vehicle (20) has been found in the default warning range. Otherwise, if the neighboring vehicles (20) are far away from the host vehicle, the processing unit (11) just keeps receiving external vehicle information packages instead of performing following tasks.

In the step of mapping coordinates system (202), the coordinates of the host vehicle and the neighboring vehicle (20) are mapped from original spherical coordinate system to the world geodetic system (WGS-84). If the geodetic coordinates of the host vehicle is expressed by $(\Lambda_0,\lambda_0,h_0)$, and the geodetic coordinates of the neighboring vehicle is expressed by $(\Lambda_1,\lambda_1,h_1)$, the coordinates system conversion can be accomplished and converts its position into a relative coordinate which is named as North-East-Down (NED) frame using following equations:

$$\begin{bmatrix} x^E \\ y^E \\ z^E \end{bmatrix} = \begin{bmatrix} (N+h)\cos\Lambda\cos\lambda \\ (N+h)\cos\Lambda\sin\lambda \\ [N(1-e^2)+h]\sin\Lambda \end{bmatrix},$$

$$N = \frac{a}{\sqrt{1-e^2\sin^2\Lambda}}$$

$$\therefore \begin{bmatrix} x^N \\ y^E \\ z^D \end{bmatrix} = \begin{bmatrix} -\cos(\lambda_0)\cdot\sin(\Lambda_0) & -\sin(\lambda_0)\cdot\sin(\Lambda_0) & \cos(\Lambda_0) \\ -\sin(\lambda_0) & \sin(\lambda_0) & 0 \\ -\cos(\lambda_0)\cdot\cos(\Lambda_0) & -\sin(\lambda_0)\cdot\cos(\Lambda_0) & -\sin(\Lambda_0) \end{bmatrix} \times \Delta p$$

$$\text{wherein } \Delta p = \begin{bmatrix} x_1^E - x_0^E \\ y_1^E - y_0^E \\ z_1^E - z_0^E \end{bmatrix}$$

In the step of categorizing collision zones (203), a possible collision position, a distance from the host vehicle to the possible collision position, and a distance from the neighboring vehicle (20) to the possible collision position are calculated and estimated based on heading angles and coordinates of the host vehicle and the neighboring vehicle (20).

Figure 3:
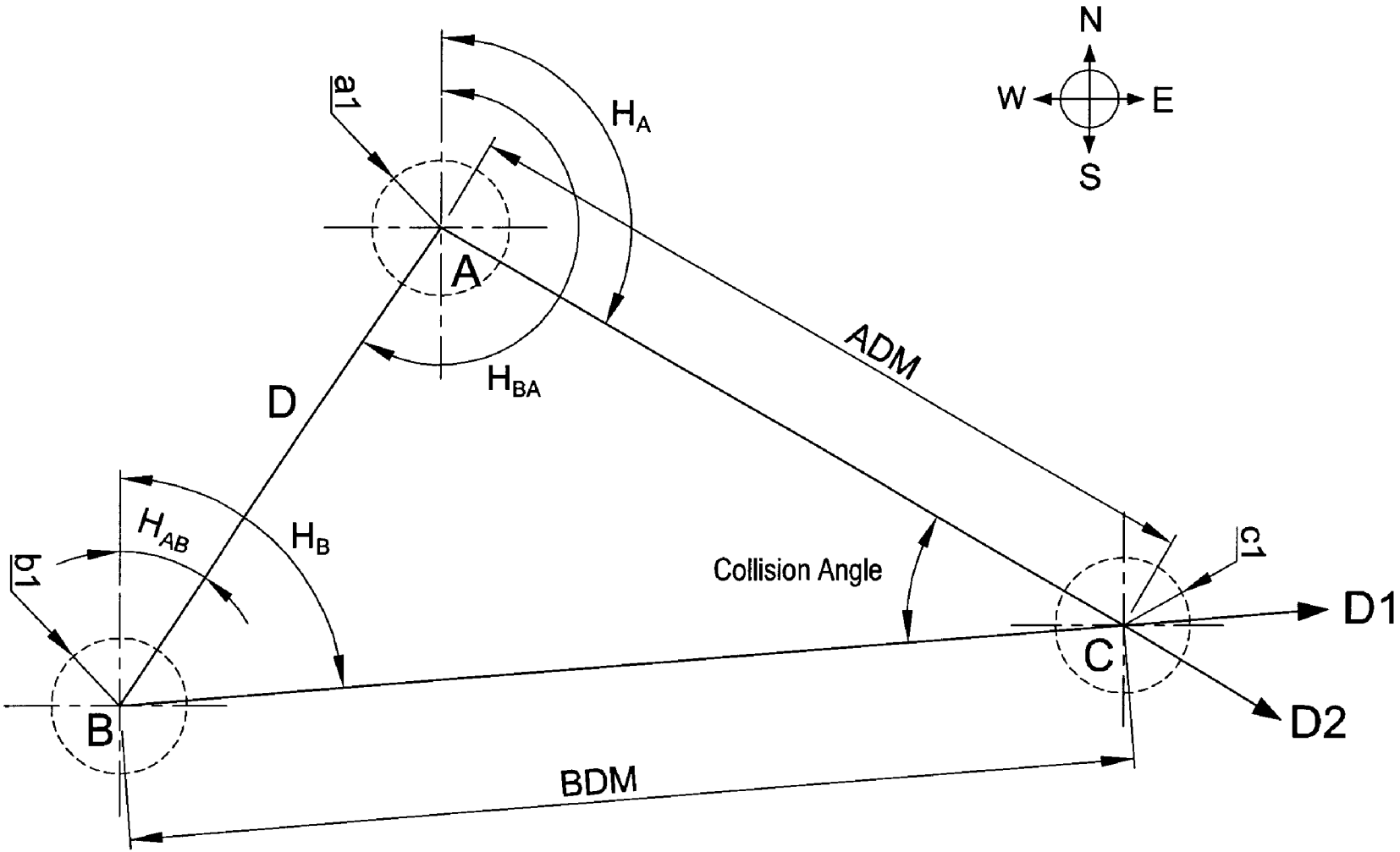
FIG. 3 shows geometric relationship between a host vehicle and a neighboring vehicle in accordance with the present invention.
Figure 4B:
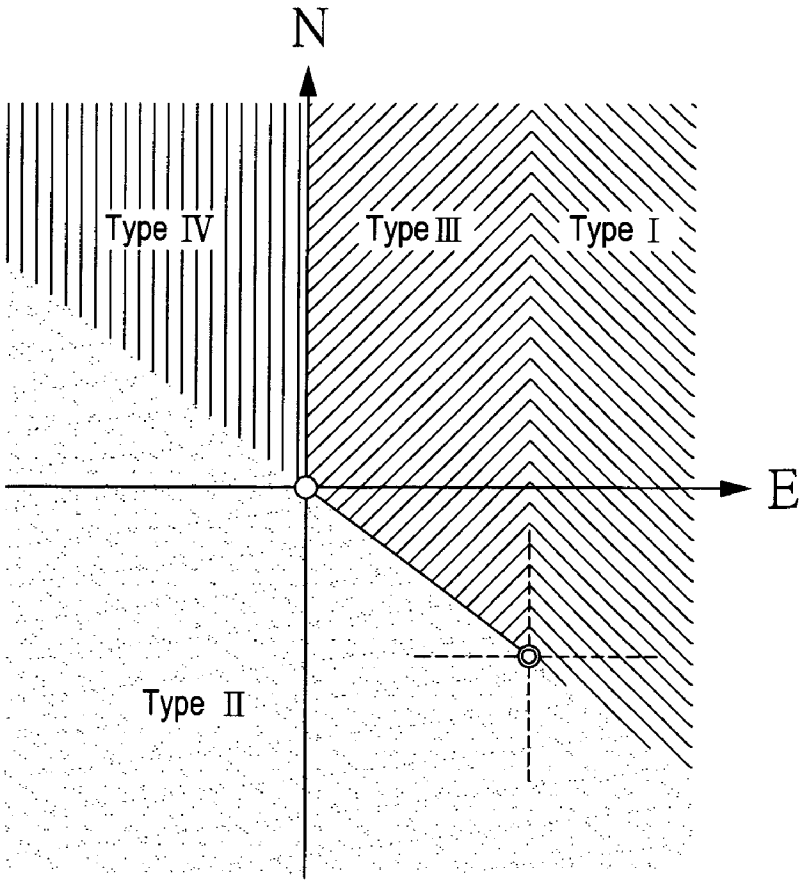
FIGS. 4A and 4B are schematic views of showing a neighboring vehicle being located in the first and the fourth quadrants respectively.
Figure 4A:
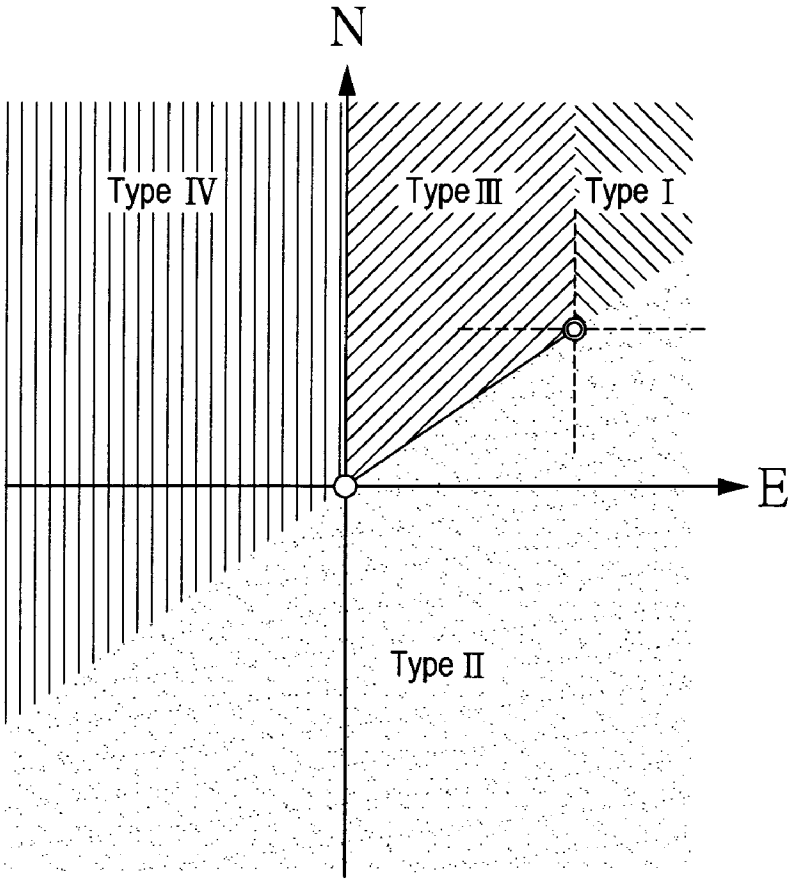
Figure 5B:
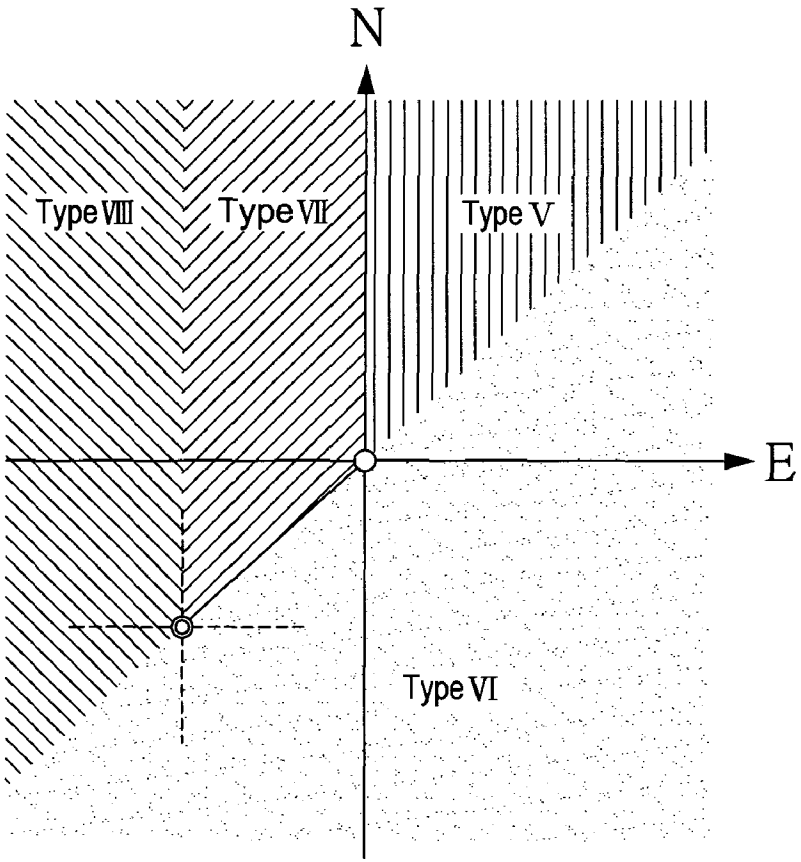
FIGS. 5A and 5B are schematic views of showing a neighboring vehicle being located in the second and the third quadrants respectively.
Figure 5A:
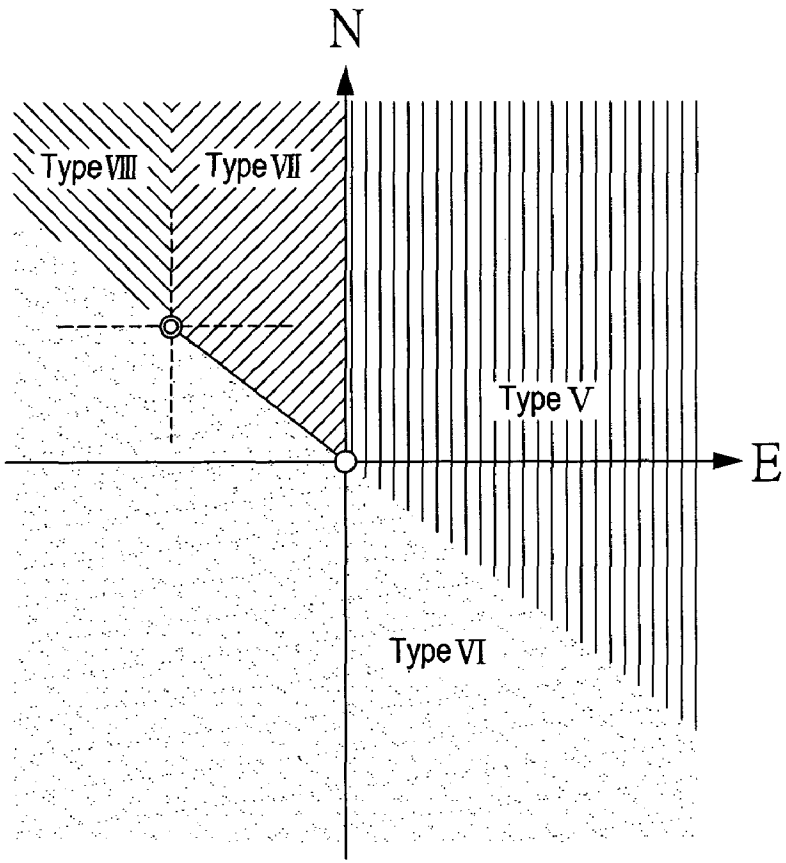

With reference to FIG. 3, symbols appeared on the drawing are defined as follows.

B: the position of the host vehicle. The host vehicle is moving along the direction D1 and the coordinates of the host vehicle may have an error indicated by the margin with a radius b1.

A: the position of a neighboring vehicle. The neighboring vehicle is moving along the direction D2 and the coordinates of the neighboring vehicle may have an error indicated by the margin with a radius b1.

C: the possible collision position. The possible collision position means an estimated place where the host vehicle and the neighboring vehicle may collide with each other and may have an error indicated by the margin with a radius c1.

$H_B$: the heading angle of the host vehicle. The heading angle $H_B$ is a known parameter measured clockwise from 0° at the true North to the driving direction D1 of the host vehicle.

$H_A$: the heading angle of the neighboring vehicle (20). The heading angle $H_A$ is a known parameter measured clockwise from 0° at the true North to the driving direction D2 of the neighboring vehicle (20).

$H_{AB}$: the host vehicle-based relative angle. Taking the position of the host vehicle B as an original, the angle $H_{AB}$ is measured clockwise from 0° at the true North to a virtual line that extends from the position of the host vehicle B to the position of the neighboring vehicle A. The angle $H_{AB}$ can be obtained by computing relative coordinates between the host vehicle and the neighboring vehicle. In this example, the angel $H_{AB}$ is an acute angle smaller than 90°.

$H_{BA}$: the neighboring vehicle-based relative angle. Taking the position of the neighboring vehicle A as an original, the angle $H_{BA}$ is measured clockwise from 0° at the true North to a virtual line that extends from the position of the neighboring vehicle A to the position of the host vehicle B. The angle $H_{AB}$ can be obtained by computing the coordinates of the host vehicle and the neighboring vehicle. In this example, the angel $H_{BA}$ is a reflex angle larger than 180°.

D: the straight distance between the host vehicle and the neighboring vehicle. The distance D can be obtained by comparing the coordinates of the host vehicle to the neighboring vehicle.

A triangular geometric relationship is defined by the three vertices A, B and C, wherein because the $H_A$, $H_B$, $H_{AB}$, $H_{BC}$ are known parameters, the internal angles □CAB (or denoted □A) and □ABC (or denoted □B) can be obtained through simple computation.

With reference to FIGS. 4A to 5B, when the position of the host vehicle B is regarded as an origin (denoted a circle symbol), the position of the neighboring vehicle A (denoted a double circle symbol) may be located in any one of the four quadrants. If the neighboring vehicle is in the first quadrant or the fourth quadrant, the internal angles □A and □B may be acquired according to equations of types I to IV as shown in the following table 1. If the neighboring vehicle is in the second quadrant or the third quadrant, the internal angle □A and □B may be calculated according to equations selected from types V to VIII as shown in the following table 2.

TABLE 1

| Internal angle | Type I | Type II | Type III | Type IV |
|---|---|---|---|---|
| □A | $2\pi - H_{BA} + H_A$ | $H_{BA} - H_A$ | $H_A - H_{BA}$ | $H_A - H_{BA}$ |
| □B | $H_{AB} - H_B$ | $H_B - H_{AB}$ | $H_{AB} - H_B$ | $2\pi + H_{AB} - H_B$ |

TABLE 2

| Internal angle | Type V | Type VI | Type VII | Type VIII |
|---|---|---|---|---|
| □A | $H_{BA} - H_A$ | $H_A - H_{BA}$ | $H_{BA} - H_A$ | $2\pi - H_A + H_{BA}$ |
| □B | $2\pi - H_{AB} + H_B$ | $H_{AB} - H_B$ | $H_B - H_{AB}$ | $H_B - H_{AB}$ |

However, only one of the foregoing eight types I to VIII can meet required conditions that the calculated two internal angles □A and □B are all positive and smaller than 180 degrees to produce the correct computation results which means the existence of a possible collision position between vehicle A and vehicle B. Otherwise, if any calculated internal angle □A or □B is negative or larger than 180 degrees, the calculation result is incorrect and abandoned, which means the possible collision position does not exist between vehicle A and vehicle B.

With reference to FIG. 3 again, when the two internal angles □A and □B are known through computation process, the last internal angle □C of the triangle □ABC, defined as a collision angle, can be acquired. Furthermore, since the straight distance D is known between the positions A and B, these interested distance parameters BDM and ADM are obtained based on the law of sines:

$$\frac{\sin(\angle A)}{BDM} = \frac{\sin(\angle B)}{ADM} = \frac{\sin(\angle C)}{D}$$

The distance parameter BDM means the distance measured from the positions of the host vehicle B to the possible collision position C. The other distance parameter ADM means the distance measured from the positions of the neighboring vehicle A to the possible collision position C.

In the step of determining whether a possible collision position exists (204), two conditions are applied to check whether a possible collision position exists or not. The first condition is to determine whether a pointing direction of a position vector $\overrightarrow{BC}$ is the same as the driving direction $H_B$ of the host vehicle. The second condition is to determine whether a pointing direction of a position vector $\overrightarrow{AC}$ is the same as the driving direction $H_A$ of the neighboring vehicle.

Figure 6B:
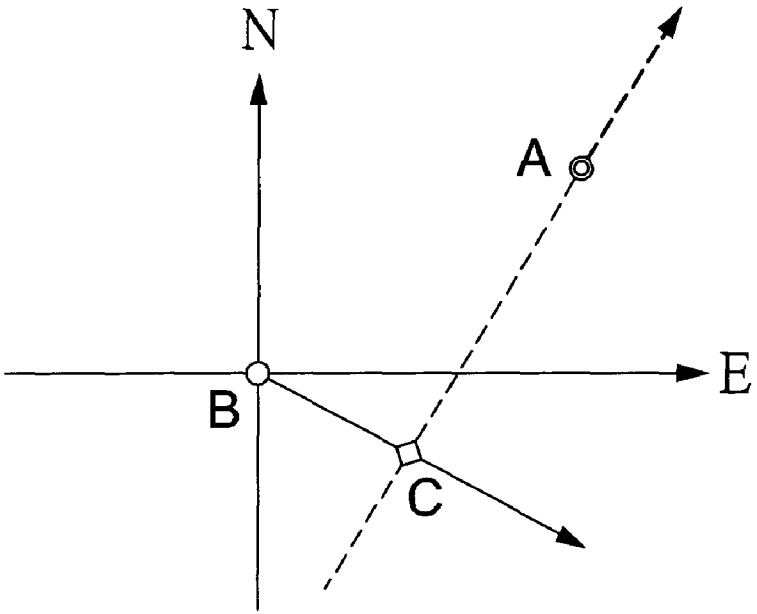
FIG. 6B is a schematic view of determining whether a possible collision position exists, wherein the possible collision position does not exist.
Figure 6A:
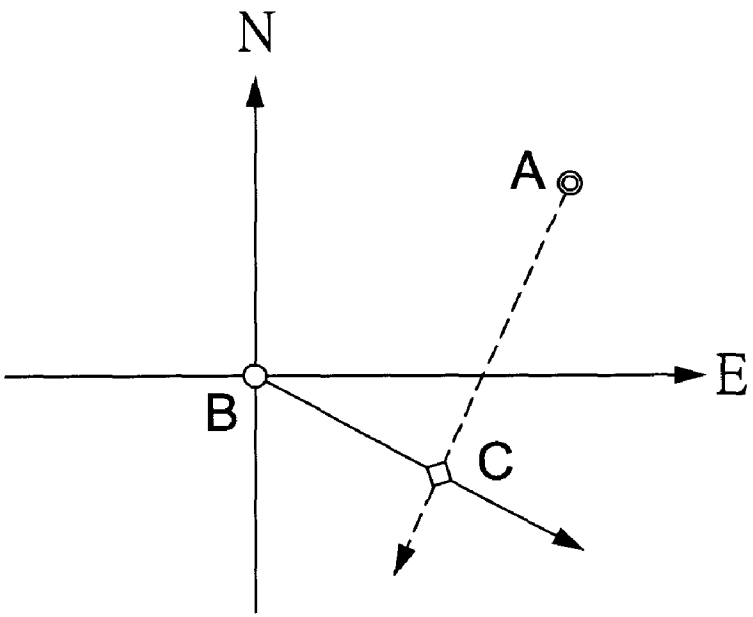
FIG. 6A is a schematic view of determining whether a possible collision position exists, wherein the possible collision position exists.

With reference to FIG. 6A, if the pointing direction of the position vector $\overrightarrow{BC}$ is the same as the driving direction $H_B$ and the pointing direction of the position vector $\overrightarrow{AC}$ is the same as the driving direction $H_A$ (indicated by a thin broken arrow), means the possible collision position C exists. When any condition does not meet, there is no possible collision position. For example, with reference to FIG. 6B, because the pointing direction of the position vector $\overrightarrow{AC}$ is opposite to the driving direction $H_A$ (indicated by a bold broken arrow), it shows that the neighboring vehicle is leaving from the place C and going to place A. Therefore, even though the host vehicle is moving from position B to C, the occurrence of a collision is impossible.

In the step of calculating collision time (205), two longitudinal collision times and a lateral collision time will be estimated. When the processing unit (11) computes the longitudinal collision times, two parameters $t_{ADM}$ and $t_{BDM}$ are calculated in accordance with the following equations. The first longitudinal collision time that the neighboring vehicle requires for moving from position A to C at the speed $V_A$ is denoted $t_{ADM}$. The second longitudinal collision time that the host vehicle requires for moving from position B to C at the speed $V_B$ is denoted $t_{BDM}$.

$$t_{ADM} = \frac{ADM}{V_A} \pm \frac{\text{error}}{V_A}$$

$$t_{BDM} = \frac{BDM}{V_B} \pm \frac{\text{error}}{V_B}$$

Figure 7A:
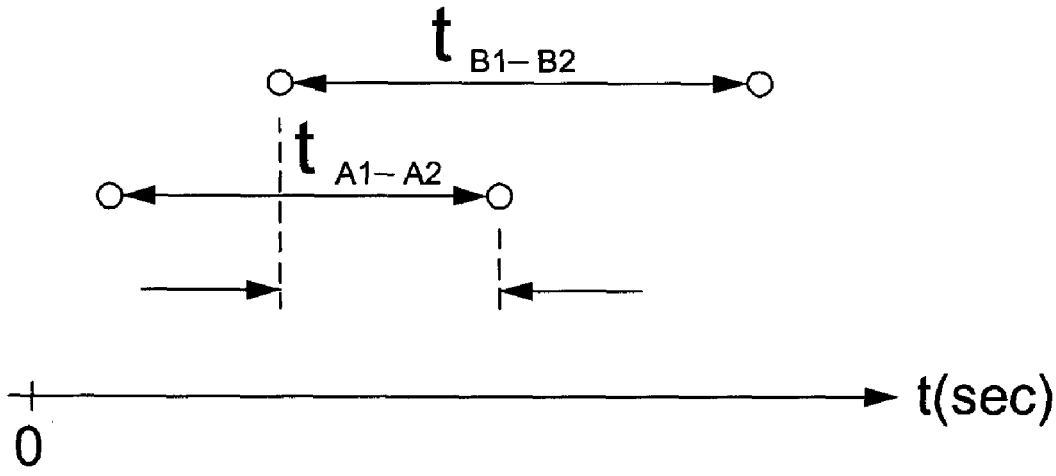
FIG. 7A is a schematic view of determining whether the longitudinal collision time of the host vehicle and that of the neighboring vehicle overlap each other, wherein the overlap exists.
Figure 7B:
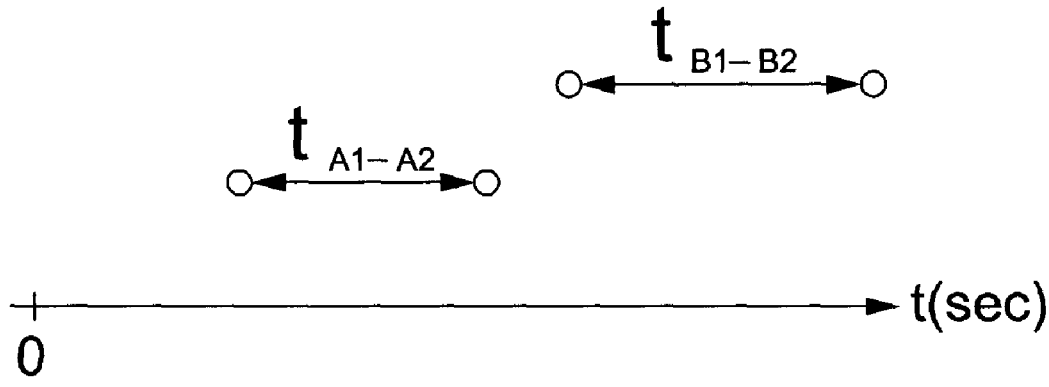
FIG. 7B is a schematic view of determining whether the longitudinal collision time of the host vehicle and the neighboring vehicle overlap each other, wherein the overlap does not exist.

With reference to FIG. 7A, an error range denoted a1 as shown on FIG. 3 can be further considered and added in the computation of the time parameter $t_{ADM}$ to obtain a proper period $t_{A1\text{-}A2}$. Similarly, the other time parameter $t_{BDM}$ also has a period $t_{B1\text{-}B2}$. If the two periods overlaps with each other, the two vehicles may collide. For example, the time period 4 to 6 seconds overlaps the other time period 5 to 7 seconds so that the collision may occur and warning messages are necessary. With reference to FIG. 7B, if the two time periods do not overlap, the collision will not occur.

Figure 8:
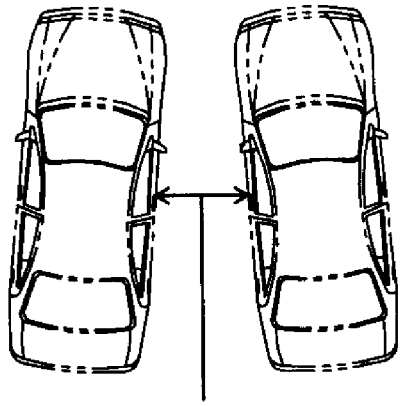
FIG. 8 is a schematic view of showing a lateral collision of the host vehicle with the neighboring vehicle.
Figure 8:
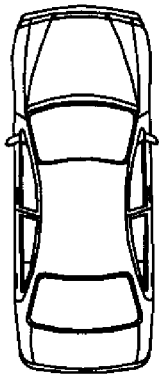
Figure 8:
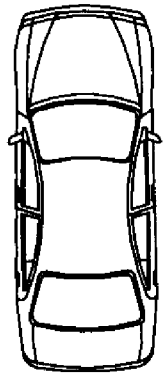

With reference to FIG. 8, if two vehicles have relative large size than normal cars, for example trucks, the lateral sides of the two vehicles may collide each other before the vehicles actually arrive the estimated possible collision position. Therefore, the lateral collision time $t_{LSM}$ is also considered in the present invention and calculated by the following equation:

$$t_{LSM} = \frac{D}{V_A \cdot \cos(\angle A) + V_B \cdot \cos(\angle B)}$$

If the lateral collision time $t_{LSM}$ is smaller than a default value, the warning messages will be output to notice the driver.

Figure 9:
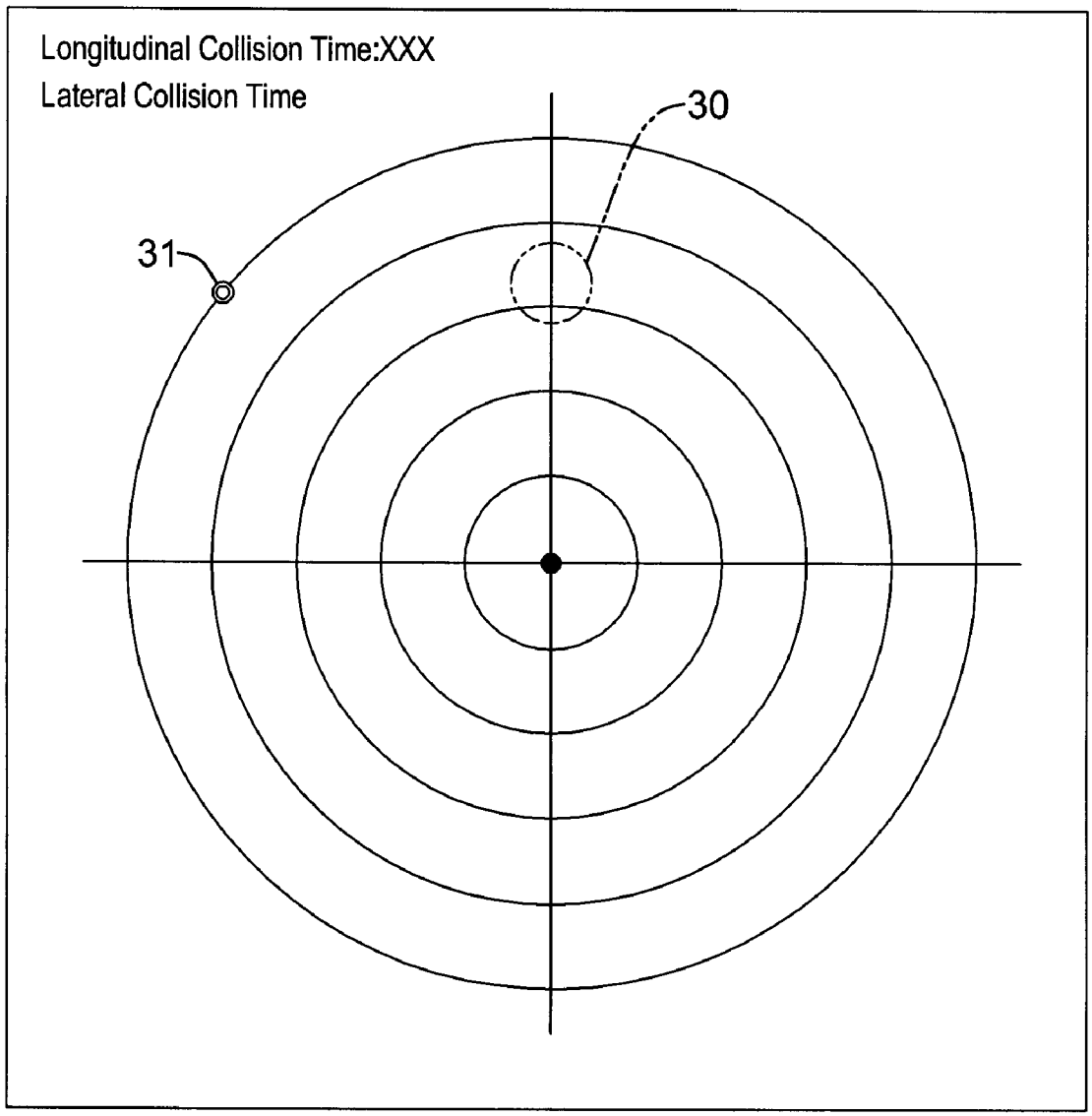
FIG. 9 is a schematic view of a warning screen in accordance with the present invention.

In the step of outputting warning messages (206), when the longitudinal collision time and the lateral collision time are acquired, the warning unit (15) is driven by the processing unit (11) to output warning messages. With reference to FIG. 9, the warning message may be a graphical image on a screen to show the position of the host vehicle as the original, the position of the neighboring vehicle (31), the estimated possible collision position (30), the longitudinal collision time and the lateral collision time.

Figure 10:
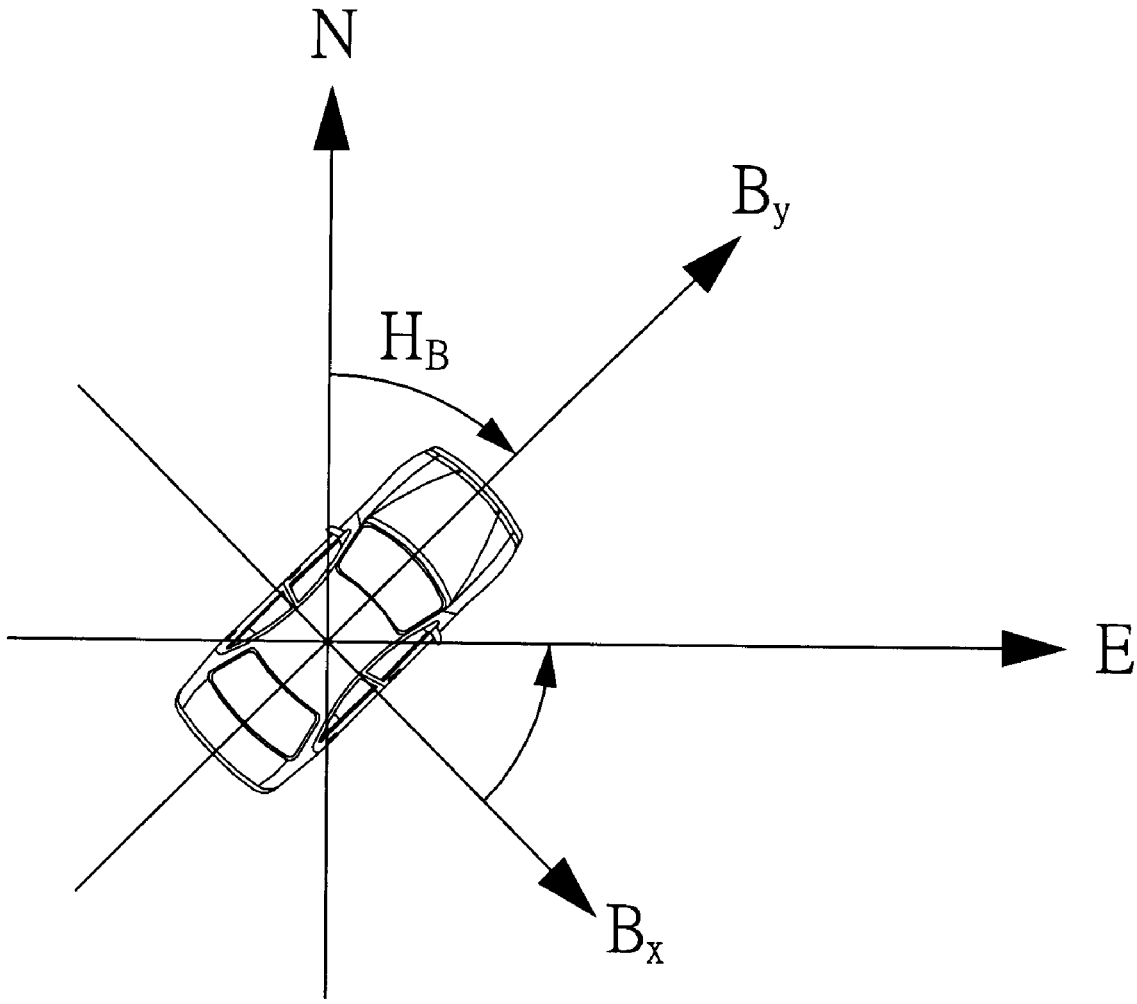
FIG. 10 is a schematic view of relative coordinate between navigation coordinate and vehicle coordinate.

With reference to FIG. 10, although vehicular information is located in navigation coordinate from data receiving to data processing, the screen display is showed in vehicular coordinate. To meet a suitable display, the display task needs a delicate approach. The display approach uses own heading angle and navigation coordinate to show a local relative information by the following equation. Each of the neighboring vehicles can be displayed at the position ($B_x$, $B_y$) on the screen calculated by the following equation:

$$\begin{bmatrix} B_x \\ B_y \end{bmatrix} = \begin{bmatrix} \cos(H_B) & -\sin(H_B) \\ \sin(H_B) & \cos(H_B) \end{bmatrix} \begin{bmatrix} x^E \\ x^N \end{bmatrix}$$

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A vehicle collision avoidance method comprising the steps of:

broadcasting vehicle information packages from a host vehicle to a neighboring vehicle and receiving external vehicle information packages sent from the neighboring vehicle, each of the vehicle information packages comprising coordinates, a driving speed and a driving direction of the corresponding vehicle;

mapping coordinates of the host vehicle and the neighboring vehicle from world geodetic system to local navigation system (NED coordinate);

categorizing collision zones by using the heading angles and the coordinates of the host vehicle and the neighboring vehicle to estimate a possible collision position, a distance from the host vehicle to the possible collision position, and a distance from the neighboring vehicle to the possible collision position;

determining whether the possible collision position exists using two conditions, wherein the first condition is to check whether a pointing direction of a first position vector defined from the host vehicle to the possible position is the same as the driving direction of the host vehicle;

the second condition is to check whether a pointing direction of a second position vector defined from the neighboring vehicle to the possible collision position is the same as the driving direction of the neighboring vehicle; and the existence of the possible collision position is confirmed when the two point directions are the same as the driving directions of the host vehicle and the neighboring vehicle respectively;

calculating a collision time by using the driving speeds, the distance between the host vehicle to the possible collision position, and the distance between the neighboring vehicle to the possible collision position to calculate at least one collision time; and outputting warning messages containing the at least one collision time and the possible collision position.

2. The method as claimed in claim 1, wherein the step of categorizing collision zones further comprises:

defining a triangular geometric relationship by the position A of the neighboring vehicle, the position B of the host vehicle and the possible collision position C;

taking a heading angle $H_B$ of the host vehicle, a heading angle $H_A$ of the neighboring vehicle, a host vehicle-based relative angle $H_{AB}$, a neighboring vehicle-based relative angle $H_{BA}$, a straight distance D between the host vehicle and the neighboring vehicle to compute two internal angles ∠A and ∠B and a collision angle ∠C;

computing two distance parameters BDM and ADM based on the law of sine $$\frac{\sin(\angle A)}{BDM} = \frac{\sin(\angle B)}{ADM} = \frac{\sin(\angle C)}{D},$$

wherein the distance parameter BDM means a distance measured from the position B of the host vehicle to the possible collision position C, the distance parameter ADM means a distance measured from the position A of the neighboring vehicle to the possible collision position C.

3. The method as claimed in claim 2, wherein the two internal angles ∠A and ∠B are computed by the steps of:

defining the position B of the host vehicle as an original and determining a quadrant of the position A of the neighboring vehicle relative to the original;

selecting a type in a group consisting of type I to type VIII to calculate the two internal angles ∠A and ∠B based on the quadrant of the position A of the neighboring vehicle, wherein the eight types are $\angle A = 2\pi - H_{BA} + H_A$, $\angle B = H_{AB} - H_B$; type I $\angle A = H_{BA} - H_A$, $\angle B = H_B - H_{AB}$; type II $\angle A = H_A - H_{BA}$, $\angle B = H_{AB} - H_B$; type III $\angle A = H_A - H_{BA}$, $\angle B = 2\pi + H_{AB} - H_B$; type IV $\angle A = H_{BA} - H_A$, $\angle B = 2\pi - H_{AB} + H_B$; type V $\angle A = H_A - H_{BA}$, $\angle B = H_{AB} - H_B$; type VI $\angle A = H_{BA} - H_A$, $\angle B = H_B - H_{AB}$; and type VII type VIII: $\angle A = 2\pi - H_A + H_{BA}$, $\angle B = H_B - H_{AB}$; type VIII wherein one of the type I to type IV is selected when the position A of the neighboring vehicle is located in the first or the fourth quadrant to obtain two positive internal angles ∠A and ∠B smaller than 180 degrees; and wherein one of the type V to type VIII is selected when the position A of the neighboring vehicle is located in the second or the third quadrant to obtain two positive internal angles ∠A and ∠B smaller than 180 degrees.

4. The method as claimed in claim 3, wherein the at least one collision time comprises a first and a second longitudinal collision time and a lateral collision time;

the first longitudinal collision time $t_{ADM}$ is calculated by an equation $$t_{ADM} = \frac{ADM}{V_A} \pm \frac{\text{error}}{V_A},$$

and $V_A$ is the driving speed of the neighboring vehicle;

the second longitudinal collision time $t_{BDM}$ is calculated by an equation $$t_{BDM} = \frac{BDM}{V_B} \pm \frac{\text{error}}{V_B},$$

and $V_B$ is the driving speed of the host vehicle; and the lateral collision time is calculated by an equation $$t_{LSM} = \frac{D}{V_A \cdot \cos(\angle A) + V_B \cdot \cos(\angle B)}.$$

5. The method as claimed in claim 1, wherein the step of outputting warning messages comprises:

displaying a graphic image containing the at least one collision time and the possible collision position.

6. The method as claimed in claim 2, wherein the step of outputting warning messages comprises:

displaying a graphic image containing the at least one collision time and the possible collision position.

7. The method as claimed in claim 3, wherein the step of outputting warning messages comprises:

displaying a graphic image containing the at least one collision time and the possible collision position.

8. The method as claimed in claim 4, wherein the step of outputting warning messages comprises:

displaying a graphic image containing the at least one collision time and the possible collision position, wherein a display position of each neighboring vehicle is calculated by an equation:

$$\begin{bmatrix} B_x \\ B_y \end{bmatrix} = \begin{bmatrix} \cos(H_B) & -\sin(H_B) \\ \sin(H_B) & \cos(H_B) \end{bmatrix} \begin{bmatrix} x^E \\ x^N \end{bmatrix}.$$

9. A vehicle collision avoidance system comprising:

a position module for providing position data of a host vehicle;

a processing unit receiving the position data, computing a driving speed and a driving direction of the host vehicle, producing vehicle information packages including the driving speed and the driving direction, storing a collision avoidance process having steps of mapping coordinates system, categorizing collision zones, determining whether a possible collision position exists, calculating a collision time and outputting warning messages;

a wireless communication module connected to the processing unit, broadcasting the vehicle information packages produced by the processing unit, receiving external vehicle information packages sent from a neighboring vehicle, and transmitting the received external vehicle information packages to the processing unit for data computation; and a warning unit connected to and driven by the processing unit to produce warning messages for noticing a vehicle driver;

wherein the collision avoidance process further comprises:

broadcasting the vehicle information packages from the host vehicle to the neighboring vehicle and receiving the external vehicle information packages sent from the neighboring vehicle, each of the vehicle information packages comprising the coordinates, the driving speed and the driving direction of the corresponding vehicle;

in the step of mapping coordinates system, the coordinates of the host vehicle and the neighboring vehicle are mapped from world geodetic system to local navigation system (NED coordinate);

in the step of categorizing collision zones, the heading angles and the coordinates of the host vehicle and the neighboring vehicle are used to estimate a possible collision position, a distance from the host vehicle to the possible collision position, and a distance from the neighboring vehicle to the possible collision position;

in the step of determining whether the possible collision position exists, two conditions are applied, wherein the first condition is to check whether a pointing direction of a first position vector defined from the host vehicle to the possible position is the same as the driving direction of the host vehicle;

the second condition is to check whether a pointing direction of a second position vector defined from the neighboring vehicle to the possible collision position is the same as the driving direction of the neighboring vehicle; and the existence of the possible collision position is confirmed when the two point directions are the same as the driving directions of the host vehicle and the neighboring vehicle respectively; and in the step of calculating a collision time, the driving speeds, the distance between the host vehicle to the possible collision position, and the distance between the neighboring vehicle to the possible collision position are applied to calculate at least one collision time.

10. The system as claimed in claim 9, wherein the warning unit is a display showing a warning image.

11. The system as claimed in claim 10, wherein the warning unit further outputs altering sounds.

12. The system as claimed in claim 9, wherein the step of categorizing collision zones further comprises:

defining a triangular geometric relationship by the position A of the neighboring vehicle, the position B of the host vehicle and the possible collision position C;

taking a heading angle $H_B$ of the host vehicle, a heading angle $H_A$ of the neighboring vehicle, a host vehicle-based relative angle $H_{AB}$, a neighboring vehicle-based relative angle $H_{BA}$, a straight distance D between the host vehicle and the neighboring vehicle to compute two internal angles ∠A and ∠B and a collision angle ∠C;

computing two distance parameters BDM and ADM based on the law of sine $$\frac{\sin(\angle A)}{BDM} = \frac{\sin(\angle B)}{ADM} = \frac{\sin(\angle C)}{D},$$

wherein the distance parameter BDM means a distance measured from the position B of the host vehicle to the possible collision position C, the distance parameter ADM means a distance measured from the position A of the neighboring vehicle to the possible collision position C.

13. The system as claimed in claim 12, wherein the two internal angles ∠A and ∠B are computed by the steps of:

defining the position B of the host vehicle as an original and determining a quadrant of the position A of the neighboring vehicle relative to the original;

selecting a type in a group consisting of type I to type VIII to calculate the two internal angles ∠A and ∠B based on the quadrant of the position A of the neighboring vehicle, wherein the eight types are $\angle A=2\pi-H_{BA}+H_A$, $\angle B=H_{AB}-H_B$; type I $\angle A=H_{BA}-H_A$, $\angle B=H_B-H_{AB}$; type II $\angle A=H_A-H_{BA}$, $\angle B=H_{AB}-H_B$; type III $\angle A=H_A-H_{BA}$, $\angle B=2\pi+H_{AB}-H_B$; type IV $\angle A=H_{BA}-H_A$, $\angle B=2\pi-H_{AB}+H_B$; tpye V $\angle A=H_A-H_{BA}$, $\angle B=H_{AB}-H_B$; type VI $\angle A=H_{BA}-H_A$, $\angle B=H_B-H_{AB}$; and type VII type VIII: $\angle A=2\pi-H_A+H_{BA}$, $\angle B=H_B-H_{AB}$; type VIII wherein one of the type I to type IV is selected when the position A of the neighboring vehicle is located in the first or the fourth quadrant to obtain two positive internal angles ∠A and ∠B smaller than 180 degrees; and wherein one of the type V to type VIII is selected when the position A of the neighboring vehicle is located in the second or the third quadrant to obtain two positive internal angles ∠A and ∠B smaller than 180 degrees.

14. The system as claimed in claim 13, wherein the at least one collision time comprises a first and a second longitudinal collision time and a lateral collision time;

the first longitudinal collision time $t_{ADM}$ is calculated by an equation $$t_{ADM} = \frac{ADM}{V_A} \pm \frac{\text{error}}{V_A},$$

and $V_A$ is the driving speed of the neighboring vehicle;

the second longitudinal collision time $t_{BDM}$ is calculated by an equation $$t_{BDM} = \frac{BDM}{V_B} \pm \frac{\text{error}}{V_B},$$

and $V_B$ is the driving speed of the host vehicle; and the lateral collision time is calculated by an equation $$t_{LSM} = \frac{D}{V_A \cdot \cos(\angle A) + V_B \cdot \cos(\angle B)}.$$

15. The system as claimed in claim 14, wherein all of the neighboring vehicles are displayed in a screen;

each of the neighboring vehicles is displayed on a position $(B_x, B_y)$ calculated by an equation:

$$\begin{bmatrix} B_x \\ B_y \end{bmatrix} = \begin{bmatrix} \cos(H_B) & -\sin(H_B) \\ \sin(H_B) & \cos(H_B) \end{bmatrix} \begin{bmatrix} x^E \\ x^N \end{bmatrix}.$$

* * * * *